US006612461B2

(12) United States Patent
Layer et al.

(10) Patent No.: US 6,612,461 B2
(45) Date of Patent: Sep. 2, 2003

(54) DEVICE FOR STORING AND FOR REMINDING AND / OR RECORDING THE INTAKE OF DRUGS

(76) Inventors: Hans Layer, Safranberg 10, Ulm (DE), 89075; Udo Simon, Virchowstrasse 18, Nuremberg (DE), 90409

( * ) Notice: Subject to any disclaimer, the term of this patent is extended or adjusted under 35 U.S.C. 154(b) by 0 days.

(21) Appl. No.: 10/032,548

(22) Filed: Jan. 2, 2002

(65) Prior Publication Data

US 2003/0121930 A1 Jul. 3, 2003

(51) Int. Cl.[7] ..... G07F 11/66
(52) U.S. Cl. ..... 221/25; 221/88
(58) Field of Search ..... 221/7, 13, 3, 25, 221/26, 74, 79, 81, 88; 206/531, 534, 536

(56) References Cited

U.S. PATENT DOCUMENTS

| | | | | |
|---|---|---|---|---|
| 4,971,221 A | | 11/1990 | Urquhart et al. | 221/2 |
| 5,405,011 A | | 4/1995 | Haber et al. | 206/531 |
| 6,062,420 A | | 5/2000 | Krouwel et al. | 221/5 |
| 6,193,103 B1 | * | 2/2001 | Clarijs | 221/25 |
| 6,474,500 B1 | * | 11/2002 | Carr et al. | 221/25 |

FOREIGN PATENT DOCUMENTS

| | | |
|---|---|---|
| DE | 89 02 268 | 5/1989 |
| DE | 198 35 940 | 2/2000 |
| DE | 198 50 890 | 5/2000 |
| FR | 2 538 791 | 7/1984 |
| WO | 97/26202 | 7/1997 |
| WO | 00/09419 | 2/2000 |

* cited by examiner

*Primary Examiner*—Kenneth W. Noland
(74) *Attorney, Agent, or Firm*—Jacobson Holman PLLC

(57) ABSTRACT

The invention relates to a device for storing and for reminding/recording the intake of drugs, arranged in a drug packaging, which is designed as individual packaging segments, which form individual pockets, holding individual drug dosages (tablets, pills, powder dosages, liquid dosages), and which are made of foil and lie in succession in the longitudinal direction. The drug packaging is guided in the device and can be transported by means of a feed in the device. The device 1 exhibits guide elements, which are arranged along the line of a peripheral guide track 6; and there are drive elements, by means of which the drug packaging 2 can be fed incrementally to a removal-ejecting mechanism 5, in which a drug dosage can be ejected through a removal window 7 at essentially right angles to the guide track 6 by means of an ejecting element.

18 Claims, 5 Drawing Sheets

DEVICE FOR STORING AND FOR REMINDING AND / OR RECORDING THE INTAKE OF DRUGS

The present invention relates to a device for storing and for reminding and/or recording the intake of drugs with the other features of the preamble of patent claim 1.

The state of the art includes drug packaging in the form of blister packs, in which the individual drug dosages, namely tablets, pills, powder or also liquid dosages, are housed in individual pockets-forming packaging segments, which lie in succession in the longitudinal direction and are separated from each other by means of connecting segments. This type of drug packaging is marketed in drug boxes, which exhibit a removal area on the side. The blister packs are usually removed from the drug container, the tablet or the capsule is pushed out, and then the blister strip is put back again into the drug container.

The state of the art also discloses blister packs, which are provided with electric conducting tracks on the perforated foil side in order to generate an electric removal signal for the attached computer, when the pills are ejected from the blister, thus severing the conducting tracks over the ejecting area. Such a device is known from the DE 198 35 940.3, where, however, entire segments of the packaging can be severed and can be recorded electronically by means of the conducting track sections, running on the packaging segments. In this device the respective blister strip is circular or meandering, whereby the respective packaging segment can be removed from a removal opening by pulling on the blister strip and severed from the same.

The object of the present invention is to provide a device for storing and for reminding and/or recording the intake of drugs. Said device guarantees that the drug dosages disposed therein will be transported reliably to the removal area.

This problem is solved by the teaching of the patent claim 1. Advantageous improvements of the device are disclosed in the dependent claims 2 to 18.

According to the invention, the device exhibits a drive element, designed as a star-shaped wheel, whose teeth, pointing radially in the outward direction, mesh with the packaging segments that form the individual pockets. The circumferential guide track ensures that the drug packaging is held and guided reliably in the device, especially during usage, during transport or similar mechanical influences. The incremental feed of the drug packaging by means of the star-shaped wheel to the removal-ejecting mechanism prevents a tablet or the like from being conveyed any further and from being removed from the removal window. The star-shaped wheel can mesh with the drug packaging or the blister strip multiple times so that a better blister guide is obtained.

Hence, the star-shaped wheel and the drug packaging act together like gearwheels, whereby the rotational motion of the star-shaped wheel results in a forward motion or rotation of the circularly configured drug packaging.

Furthermore, the device of the invention has the special advantage that the already emptied portion of the drug packaging remains in the device, and the user does not have to worry about the disposal. Rather the consumed segment of the drug packaging also serves to guide better the entire drug packaging in the device.

The guide track can be designed circular or oval so that the drug packaging can be inserted in a simple manner into the guide track without bending said packaging. In addition, the circular or oval design of the guide track guarantees a compact assembly of the entire device and an optimal guide of the drug packaging disposed therein.

The drive element or the star-shaped wheel exhibits the special advantage that it can mesh with the opposite sides of the drug packaging. Hence, the star-shaped wheel meshes twice, thus achieving a better blister guide. The twin guide is especially advantageous when owing to its limited length the drug packaging or the blister strip can no longer be grasped by the star-shaped wheel on one side. Then it is guaranteed that said strip is moved forward on the other side.

In so doing, the star-shaped wheel can mesh with the opposite packaging segments, located on the periphery. Since the star-shaped wheel meshes twice, only half the force is required on each side to advance the drug packaging. If the tablets or pills are arranged vertically to the packaging plane in the drug packaging, it is easier for the teeth of the star-shaped wheel to mesh with the individual pockets that protrude more.

As an alternative it is possible for the star-shaped wheel to mesh with a sprocket hole, similar to that of a reel of film, of the drug packaging. The teeth or the tooth is provided with a corresponding tip, which can engage with the respective hole.

The guide track can exhibit a peripheral channel, in which the laterally projecting edge of the drug packaging or the blister is guided. The channel can be formed by the wall of the device and by a guide leg in the interior of the housing.

The ejecting element can be loaded by a spring, which moves the ejecting element into the ejecting position due to its spring force. To actuate the device, the user has to move the ejecting element counter to the ejecting position, whereby the next individual pocket moves in front of the removal window and the tablet therein is ejected by means of the ejecting element, which exerts a force due to the thrust and spring effect. The ejecting element remains in this extended position, thus fixing the ejected blister pocket in position. Thus, with this construction it is also possible to further stabilize the position by means of the ejecting element.

The ejecting element is expediently designed as an ejecting ram and can generate the necessary force to eject the tablet or another drug dosage from the drug pocket.

The ejecting element can interact in an especially advantageous manner with the drive element so that, when the user merely actuates the ejecting element, the drug packaging is advanced incrementally at the same time. Hence, when the ejecting element is actuated the next time, the next tablet can be automatically ejected through the removal window.

The ejecting element can be connected to an actuating ram, which causes the star-shaped wheel to turn. The actuating ram engages with the teeth, which are also provided on the star-shaped wheel and whose number is identical to the number of the teeth enveloping the individual pockets. When the ejecting element is actuated once, the star-shaped wheel rotates by one step, with the result that the drug packaging is advanced at the same time by one packaging segment. Thus, the ejection procedure is coupled in a simple manner with the forward motion of the drug packaging.

Furthermore, the removal-ejecting mechanism or the ejecting element can be connected to the switch ram, which actuates an electric contact. The electric contact can be connected to a counter. When the ejecting element is actuated, an automatic counter can be operated simultaneously in order to record the quantity of the drug that was removed.

Thus, actuation of the ejecting element results in the simultaneous advance of the drug packaging and the actuation of the electric contact.

It is practical to design the ejecting element, the actuating ram and the switch ram as a single-part module, in particular as an injection molded part. Thus, the three elements, which interact functionally, can be produced in one production step and thus relatively economically.

The ejecting element can be held by a guide element, which stabilizes the ejecting element in its two end positions and simultaneously acts against the force acting on the ejecting element.

The guide element can envelop like a clamp the ejecting element and thus prevent the ejecting element from sliding laterally.

It is practical to fix the ejecting element in the ejecting position so that the position of the drug packaging is further stabilized.

The device exhibits advantageously an indicating unit, which is connected to the counter. The indicating unit shows the quantity of tablets that have already been removed or that are still in the drug packaging. The indicating unit can also be connected to a microchip that stores, for example the current time or the current date. Furthermore, there can be a microprocessor, which sends a signal at a specific time to the indicating device and reminds the user to take the medication.

It is especially advantageous to provide a stop ramp at the wall in the vicinity of the removal window. When inserted, the outermost end of the drug packaging or the blister strip rests against the ramp's wide end, projecting into the guide track. The distance between the last packaging segment and the end of the drug packaging is chosen in such a manner that when the drug packaging is incorrectly inserted, the end section of the drug packaging would lie directly in front of the removal window and hence the ejecting element could not be fixed in its ejecting position. Consequently the stop ramp prevents an incorrect insertion of the drug packaging. Thus, in the case of multiphase preparations (for example, the birth control pill) it is extremely important that the drug packaging be correctly inserted. Owing to the reduced height of the ejected packaging segment it can slide easily over the stop ramp as it is advanced.

The drug dosages, in particular the flat tablets or pills, can be arranged vertically in relation to the packaging plane. This arrangement results, as compared to a conventional drug packaging, where the tablets or pills are arranged horizontally to the packaging plane, in a decrease in the total length of the drug packaging. This feature is especially important in the aforementioned, inventive device, wherein a drug packaging with a correspondingly higher number of drug dosages can be housed.

The invention is explained in detail with reference to advantageous embodiments in the drawings.

Figure 8A:
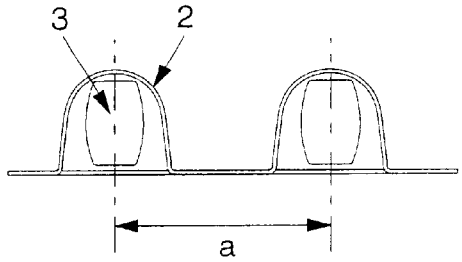

FIG. 8*a* depicts a possible inventive and

Figure 8B:
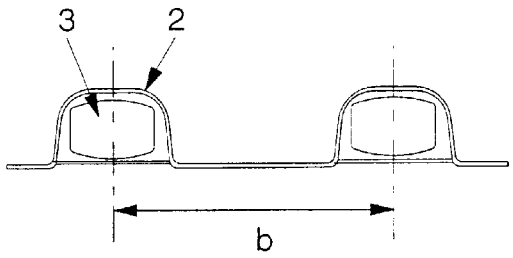

FIG. 8*b* a possible conventional arrangement of the tablets in a drug packaging.

Figure 2:
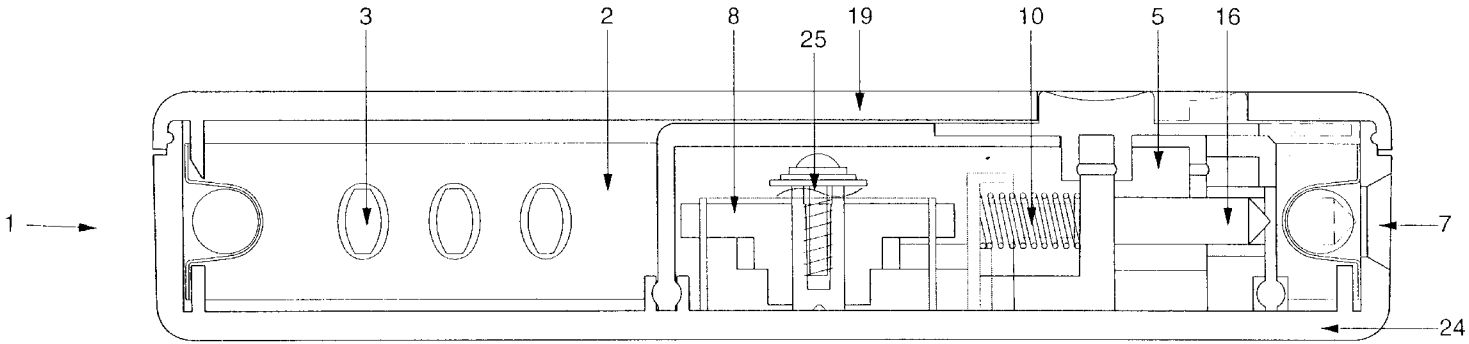
FIG. 2 is a sectional view along the line II—II of FIG. 1.
Figure 3:
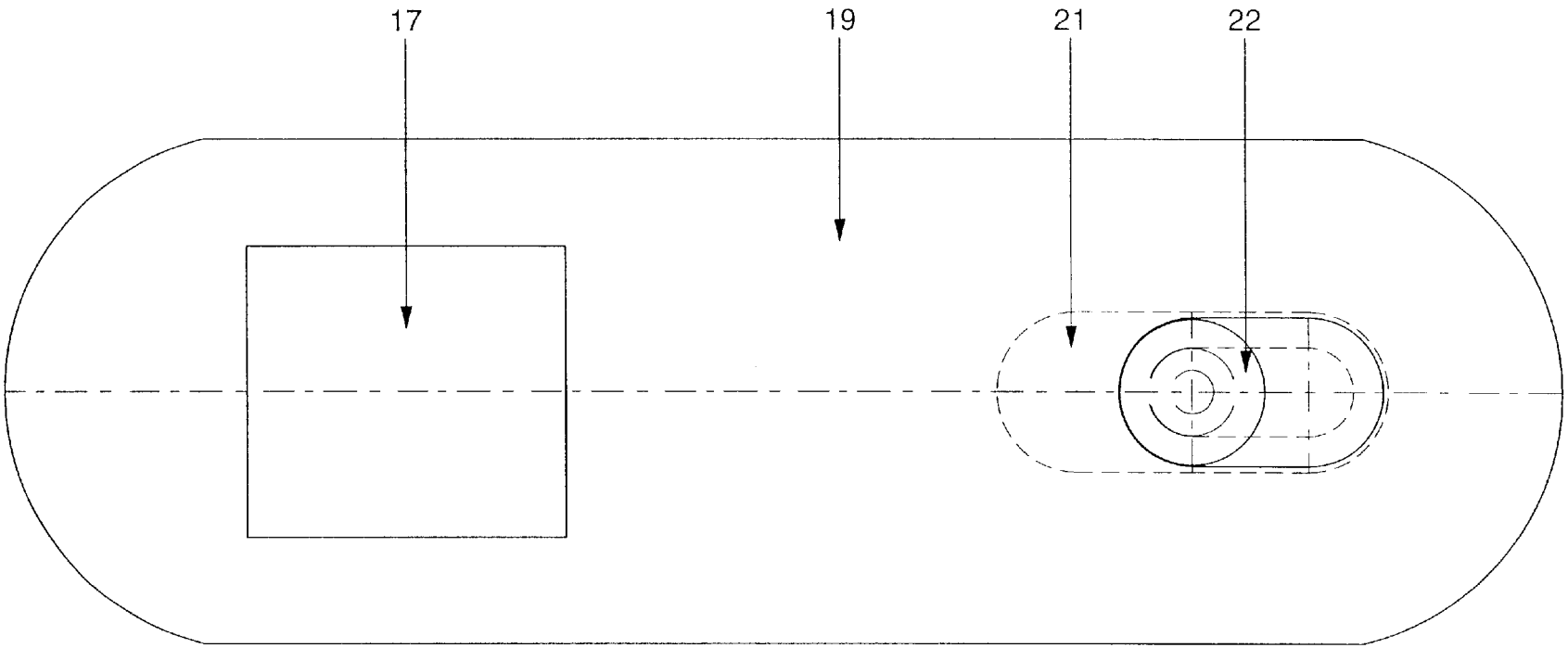
FIG. 3 is a top view of the device with cover.

Reference numeral 1 refers to the device in its entirety. The device 1 serves to store and to remind and/or record the intake of drugs, arranged in the drug packaging 2, which is designed as packaging segments 4, forming the individual pockets for receiving individual tablets 3. The packaging segments 4 are made of foil material and lie in succession in the longitudinal direction. The drug packaging 2 or the blister strip is guided in the device 1 and can be transported by means of a feed in the device 1. It is especially clear from FIG. 2 that the device 1 comprises a housing 24, sealed with a cover 19.

The device 1 exhibits guide elements, positioned along the line of a guide track 6 arranged within the device and preferably inset adjacent a periphery thereof. Furthermore, there are drive elements, by means of which the drug packaging 2 can be fed incrementally to a removal-ejecting mechanism 5, in which the tablet 3 can be ejected at essentially right angles to the guide track 6 through a removal window 7 by means of an ejecting element. In this respect the guide track 6 guarantees a reliable hold of the drug packaging 2, especially when feeding the drug packaging to the removal-ejecting mechanism 5.

The incremental feed of each individual packaging segment 4 to the removal-ejecting mechanism 5 guarantees that only one tablet 3 is removed and that a tablet is not advanced by mistake or that a tablet remains in the device 1.

The guide track 6 is designed oval so that the drug packaging 2 can be easily inserted, and at the same time the shape enables a good guide.

Figure 1:
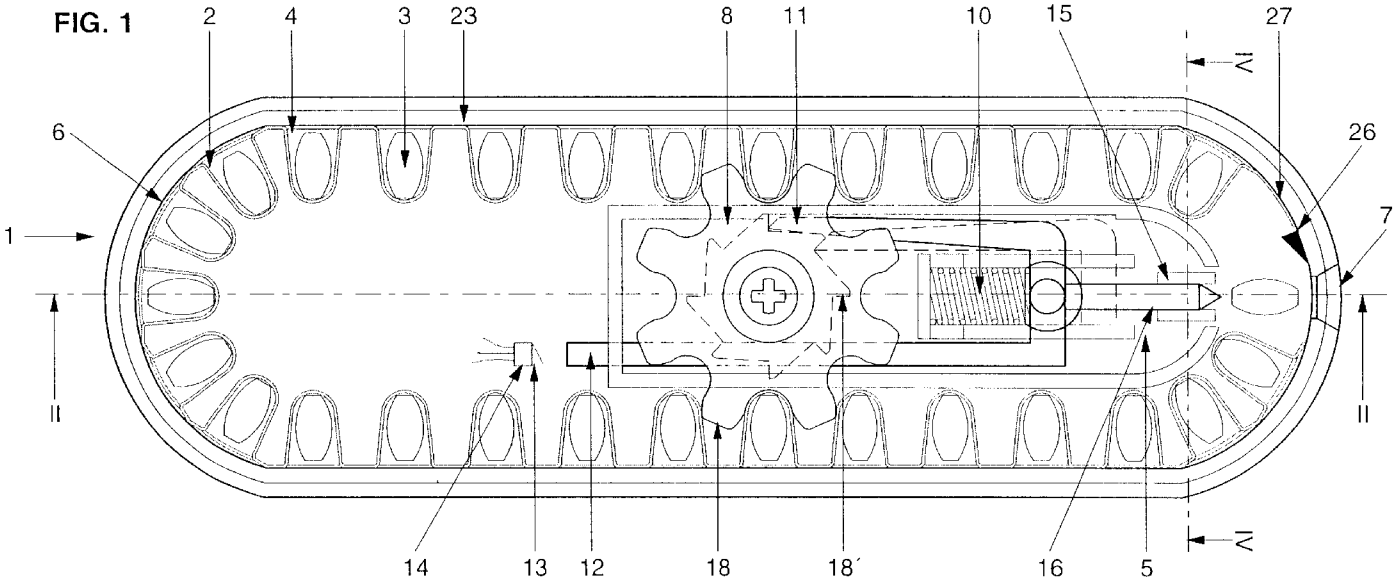
FIG. 1 is a top view of the inventive device without cover.
Figure 7:
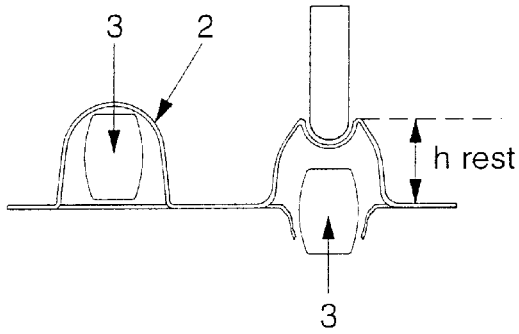
FIG. 7 is a schematic drawing of the ejection process of a drug dosage.

As evident from FIG. 1, the drive element is designed as a star-shaped wheel 8. The star-shaped wheel 8 meshes with the opposite packaging segments 4 of the drug packaging 2. Thus, the teeth 18 of the star-shaped wheel 8 mesh with or envelop the opposite packaging segments 4, located on the periphery. The goal of this twin guide is the accurate guide of the blister. Thus, the star-shaped wheel 8 can mesh with both filled and also unfilled, that is ejected, blister pockets (see FIG. 7), and thus continue to transport the drug packaging 2. The twin guide is especially important when the blister strip leaves the guide owing to its possibly limited length on one side. Then, at least the guide on the opposite side is guaranteed.

Figure 5:
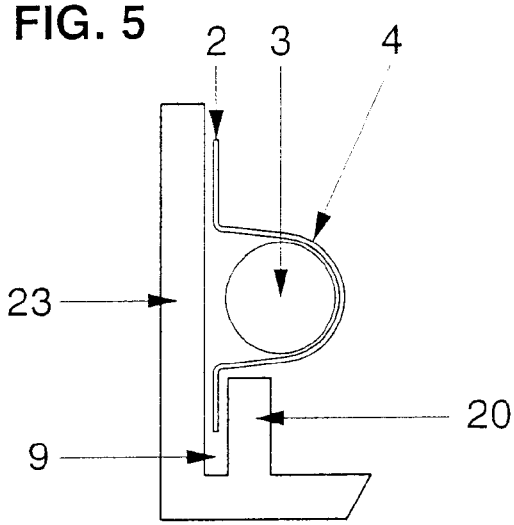
FIG. 5 is a detailed view of the guide track.
Figure 6:
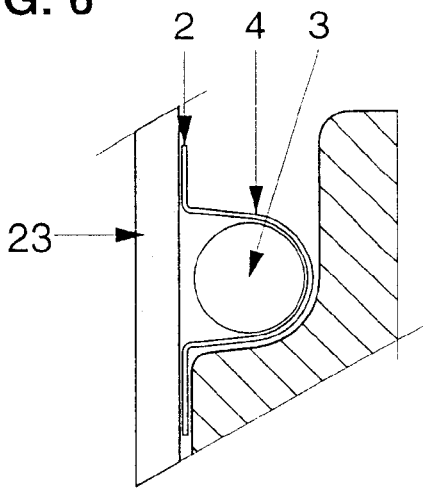
FIG. 6 is another detailed view of the guide track.

The guide track exhibits a peripheral channel 9 (see FIG. 5). The laterally protruding edge of the drug packaging 2 is guided in this peripheral channel 9. The channel 9 may be formed by a peripheral leg 20. The peripheral channel 9 also serves to insert the drug packaging 2 in a defined manner. As evident from FIG. 5, the channel can be designed in such a manner that the production-induced tolerances of the side edges of the drug packaging 2 are supported. Thus, it is guaranteed that the individual packaging segment 4 is always positioned in an optimal position in relation to the removal window 7. In both cases the drug packaging 2 rests against the wall 23 of the housing 24.

The ejecting element, which is designed as the ejecting ram 16, is loaded by a spring 10. The spring 10 moves the ejecting ram 16 automatically into the ejecting position so that for the user to actuate the removal-ejecting mechanism 5 the handle 22 must be pushed counter to the ejecting direction so that the next individual pocket moves in front of the removal window 7. To eject the tablet 3, the ejecting ram 16 must be moved in the ejecting direction. Then said ram ejects the tablet 3 through the removal window 7 by means of the thrust and spring force. If, however, the force of the spring 10 is chosen adequately large, the ejecting ram 16 need only be released so that the tablet 3 is pushed through the removal window 7 by means of the spring force. The removal ram 16 remains finally in the extended position, thus stabilizing the position of the individual pocket or the drug packaging 2 in the area of the removal window 7.

The ejecting ram 16 interacts with the star-shaped wheel 8. That is, when the ejecting ram 16 is actuated, the star-shaped wheel 8 turns at the same time. To this end, the ejecting ram 16 is connected to an actuating ram 11, which engages with the teeth 18', arranged below the teeth 18, and thus sets the star-shaped wheel 8 into rotational motion. In this respect the number of teeth 18' agrees with the number of teeth 18, enveloping the individual packaging segments 4, so that, when the star-shaped wheel 8 is actuated once by means of the actuating ram 11, the drug packaging 2 is advanced by one packaging segment 4. FIG. 1 shows the motion of the actuating ram 11. In this respect the dash-dotted line represents the starting position and the solid line represents the end position of the actuating ram 11.

The spring washer 25 pushes the star-shaped wheel 8 against the floor of the housing 24. If the ejecting ram 16 is moved counter to the ejecting direction, then said ram engages with one of the teeth 18' and moves the star-shaped wheel 8 by one step. To prevent the ejecting ram 16 from jamming below the star-shaped wheel 8 when moving in the ejecting direction, the star-shaped wheel can move to the top in the direction of the cover 19, using a spring washer 25. As soon as a dosage is removed and the ejecting ram 16 is again in normal position, the spring washer 25 pushes the star-shaped wheel 8 again against the floor of the housing 24.

The ejecting ram 16 is also connected to a switch ram 12, actuating an electric contact 13. This means that as the ejecting ram 16 moves, both the actuating ram 11 and the switch ram 12 move simultaneously. The electric contact 13 contacts a counter 14 so that the number of tablets 3 that were removed can be recorded by means of the actuation of the electric contact 13.

The ejecting ram 16, the actuating ram 11 and the switch ram 12 are designed as a single-part module, in particular as an injection molded part, and can be produced thus in one single production step.

Figure 4:
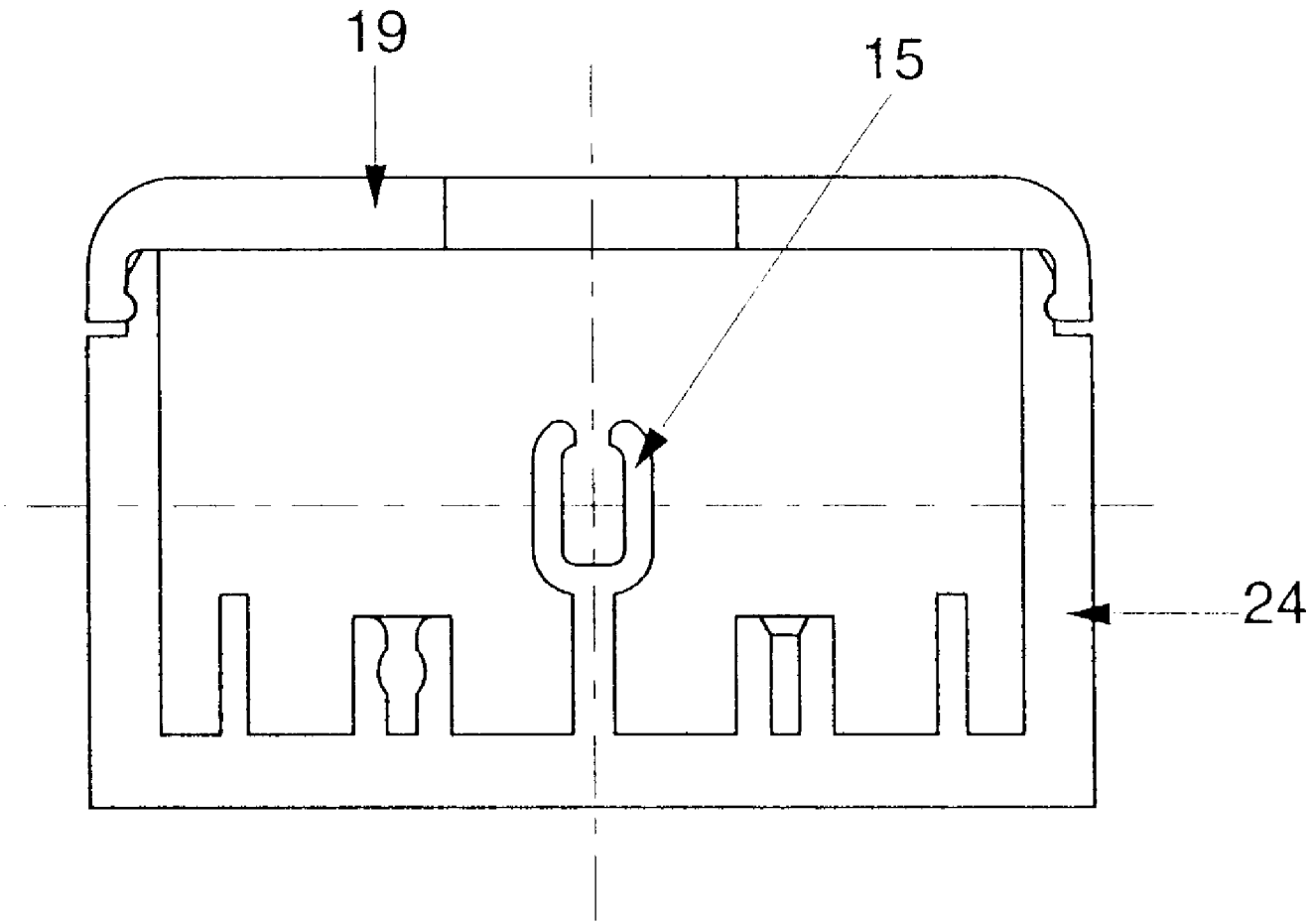
FIG. 4 is a sectional view along the line IV—IV of FIG. 1.

The ejecting ram 16 is held by a guide element 15, which is depicted clearly in FIG. 4. The guide element 15 is designed along the line of a clamp so that the ejecting ram 16 guided therein cannot slide laterally, above all, when ejecting the tablet 3.

The counter 14 is connected to an indicating unit 17, which can be seen through a viewing window in the cover 19. The indicating unit 17 can also be connected to a microprocessor, which sends, for example, the current date/the current time, and reminds the user to take the medication, for example, by means of a warning signal to the indicating unit 17. The cover 19 is also provided with an opening 21, through which the handle 22, connected to the ejecting ram 16, can be actuated from the outside.

FIG. 8 depicts an especially advantageous arrangement of the tablets 3 in the drug packaging 2. Normally the flat tablets 3 are arranged in the blister strip, according to FIG. 8*b*. In the inventive embodiment, according to FIG. 8*a*, the tablets 3 are arranged vertically to the packaging plane so that the distance a from tablet to tablet is clearly decreased as compared to the typical distance b. Thus, it is possible to house an increased number of tablets 3 or pills while the length of the drug packaging 2 remains constant. For the inventive device 1, this drug packaging 2 has the advantage that an increased number of tablets 3 can be stored. However, a special advantage lies in the fact that the teeth 18 can mesh in such a manner with the individual pocket-forming packaging segments 4 that a stable advancing motion of the drug packaging 2 is guaranteed. As evident from FIG. 7, an already ejected blister pocket also guarantees a requisite height $h_{rest}$, with which the star-shaped wheel 8 can engage.

A stop ramp 26, which is arranged on the wall 23 in the vicinity of the removal window 7, serves to insert correctly the drug packaging 2. The correspondingly dimensioned end section 27 of the drug packaging 2 strikes the wide end of the stop ramp 26. Should the drug packaging 2 have been incorrectly inserted into the device 1, then the end section 27 would lie in front of the removal window 7 and the ejecting ram 16 could not move into its fixing ejecting position. Thus, the entire conveying mechanism would be blocked and thus an incorrect removal sequence would be ruled out. Furthermore, the stop ramp 26, projecting into the guide track 6, does not prevent the already ejected packaging segments 4 from being conveyed further, since owing to their reduced height they can slide easily over the stop ramp 26.

On the whole, the present invention guarantees a significant contribution in the field of drug packaging.

LIST OF REFERENCE NUMERALS

1 device
2 drug packaging
3 tablet
4 packaging segment
5 removal-ejecting mechanism
6 guide track
7 removal window
8 star-shaped wheel
9 channel
10 spring
11 actuating ram
12 switch ram
13 electric contact
14 counter
15 guide element
16 ejecting ram
17 indicating unit
18, 18' tooth
19 cover
20 guide leg
21 opening
22 handle
23 wall
24 housing
25 spring washer
26 stop ramp
27 end section

What is claimed is:

1. Device for storing and for reminding/recording the intake of drugs, arranged in a drug packaging, which is designed as individual packaging segments, which form individual pockets, holding individual drug dosages (tablets, pills, powder dosages, liquid dosages), and which are made of foil and lie in succession in the longitudinal direction and are sealed with a foil that can be punched through, whereby the drug packaging is guided in the device and can be transported by means of a feed in the device, whereby the device (1) exhibits guide elements, configured along the line of a guide track (6) which is arranged within the device and preferably runs adjacent a periphery thereof, and there are drive elements, by means of which the drug packaging (2) can be fed incrementally to a removal-ejecting mechanism (5), in which a drug dosage can be ejected through a removal window (7) at essentially right angles to the guide track (6) by means of an ejecting element, and whereby the device comprises electronic switching means for reminding the intake and for recording when a drug dosage is removed, characterized in that the drive elements are designed as a star-shaped wheel (8), whose teeth, pointing radially outwards, mesh with the packaging segments (4), forming the individual pockets.

2. Device, as claimed in claim 1, characterized in that the guide track (6) is oval.

3. Device, as claimed in claim 1, characterized in that the star-shaped wheel (8) meshes with the opposite packaging segments (4), lying on the periphery.

4. Device, as claimed in claim 1, characterized in that the guide track exhibits a peripheral channel (9).

5. Device, as claimed in claim 1, characterized in that the ejecting element is driven by a spring (10).

6. Device, as claimed in claim 1, characterized in that the ejecting element is designed as an ejecting ram (16).

7. Device, as claimed in claim 1, characterized in that the ejecting element interacts with the drive element.

8. Device, as claimed in claim 7, characterized in that the removal-ejecting mechanism (5) or the ejecting element is connected to an actuating ram (11), which actuates the rotation of the star-shaped wheel (8).

9. Device, as claimed in claim 1, characterized in that the removal-ejecting mechanism (5) or the ejecting element is connected to a switch ram (12), which actuates an electric contact (13).

10. Device, as claimed in claim 9, characterized in that the electric contact (13) contacts a counter (14).

11. Device, as claimed in claim 9, characterized in that the electric contact (13) is integrated into the counter (14).

12. Device, as claimed in claim 1, characterized in that the ejecting element, the actuating ram (11) and the switch ram (12) are designed as a single-part module.

13. Device, as claimed in claim 1, characterized in that the ejecting element is held by a guide element (15).

14. Device, as claimed in claim 13, characterized in that the guide element (15) envelops the ejecting element like a clamp.

15. Device, as claimed in claim 1, characterized in that the ejecting element can be fixed in the ejecting position.

16. Device, as claimed in claim 1, characterized in that there is an indicating unit (17).

17. Device, as claimed in claim 16, characterized in that the indicating unit (17) is connected to the counter (14).

18. Device, as claimed in claim 1, characterized in that a stop ramp (26) is provided on the wall (23) in the vicinity of the removal window (7).

* * * * *